US005703473A

United States Patent [19]

Phillips et al.

[11] Patent Number: 5,703,473

[45] Date of Patent: Dec. 30, 1997

[54] PROGRAMMABLE PWM OUTPUT VOLTAGE INDEPENDENT OF SUPPLY

[75] Inventors: Timothy A. Phillips, Cranston; J. Eric Lindberg, East Greenwich, both of R.I.

[73] Assignee: Cherry Semiconductor Corporation, East Greenwich, R.I.

[21] Appl. No.: 672,267

[22] Filed: Jun. 27, 1996

Related U.S. Application Data

[60] Provisional application No. 60/009,985, Jan. 2, 1996.

[51] Int. Cl.[6] ..... G05F 1/565

[52] U.S. Cl. ..... 323/282; 323/285; 363/21

[58] Field of Search ..... 323/282, 284, 323/286, 285; 363/20, 21, 80, 89

[56] References Cited

U.S. PATENT DOCUMENTS

| | | | |
|---|---|---|---|
| 4,301,497 | 11/1981 | Johari | 363/21 |
| 4,618,812 | 10/1986 | Kawakami | 323/224 |
| 4,975,820 | 12/1990 | Szepesi | 363/21 |
| 5,170,333 | 12/1992 | Niwayama | 363/21 |
| 5,490,055 | 2/1996 | Boylan et al. | 363/41 |
| 5,514,947 | 5/1996 | Berg | 323/282 |

*Primary Examiner*—Peter S. Wong
*Assistant Examiner*—Rajnikant B. Gate
*Attorney, Agent, or Firm*—Bromberg & Sunstein LLP

[57] ABSTRACT

A pulse width modulator that provides a square wave signal whose duty cycle is proportional to a control voltage and inversely related to the power supply voltage applied to the circuit. The pulse width modulator compensates the output voltage applied across a load for variations in the power supply voltage.

35 Claims, 2 Drawing Sheets

PROGRAMMABLE PWM OUTPUT VOLTAGE INDEPENDENT OF SUPPLY

BACKGROUND OF THE INVENTION

The present application claims priority from U.S. provisional application number 60/009,985, filed Jan. 2, 1996.

The present invention relates to a pulse width modulator circuit for providing a square wave whose duty cycle compensates for variations in supply voltage. The application for this invention arises when it is necessary to provide a programmable voltage across a load such as a motor or lamp. A power device, such as a power MOSFET, is connected to the load, either on the supply or ground side. The output of the pulse width modulator is applied to the gate, or base, of the power device, driving it to conduct and pull the output up to positive supply, when the pulse width modulator output is high. When the pulse width modulator output is low, the flow of current through the power device is prevented, thus allowing the output to float to ground. By adjusting the pulse width in response to a programming signal, a specified average output voltage can be maintained.

In many applications, the supply voltage is not constant, owing to variations in load or other causes. Furthermore, the input voltage which is intended to control the output voltage has no correlation to the supply voltage and thus cannot compensate for supply voltage variations. Unless variations in supply voltage are compensated, the variance in voltage across the load will be directly proportional to the variance in supply voltage. This is undesirable in applications where, for example, dependence on supply voltage results in a noticeable variation in lamp intensity or motor speed. In accordance with this invention, the duty cycle can be accurately altered to compensate for variations in supply voltage to yield a constant average output voltage.

SUMMARY OF THE INVENTION

In accordance with one formulation of the present invention, a pulse width modulator circuit is provided for supplying a train of square pulses whose width is proportional to an applied control voltage and inversely proportional to a power supply voltage. The pulse width modulator circuit has a comparator with two inputs. One comparator input is connected to an oscillator which provides a periodic voltage ramp whose peak output voltage is proportional to the power supply voltage. The second comparator input is connected to the output of a summing means which receives a control voltage and a signal proportional to the power supply voltage and supplies a linear combination of the control signal and the power supply voltage to the second comparator input.

In accordance with an embodiment of the present invention, the pulse width of the output of the pulse width modulation is controlled so that the average supply voltage across the load and power device will not vary in response to variations in the supply voltage. The pulse width modulator circuit described herein advantageously provides the capability to drive a power device with a square wave whose duty cycle accurately compensates for variations in supply voltage. The circuit of the present invention further advantageously provides a novel voltage-compensating pulse width modulator circuit which is of relatively simple and inexpensive construction. Other objects and advantages of the invention are in part apparent and in part pointed out hereinafter.

DETAILED DESCRIPTION OF THE PREFERRED EMBODIMENTS

Figure 1:
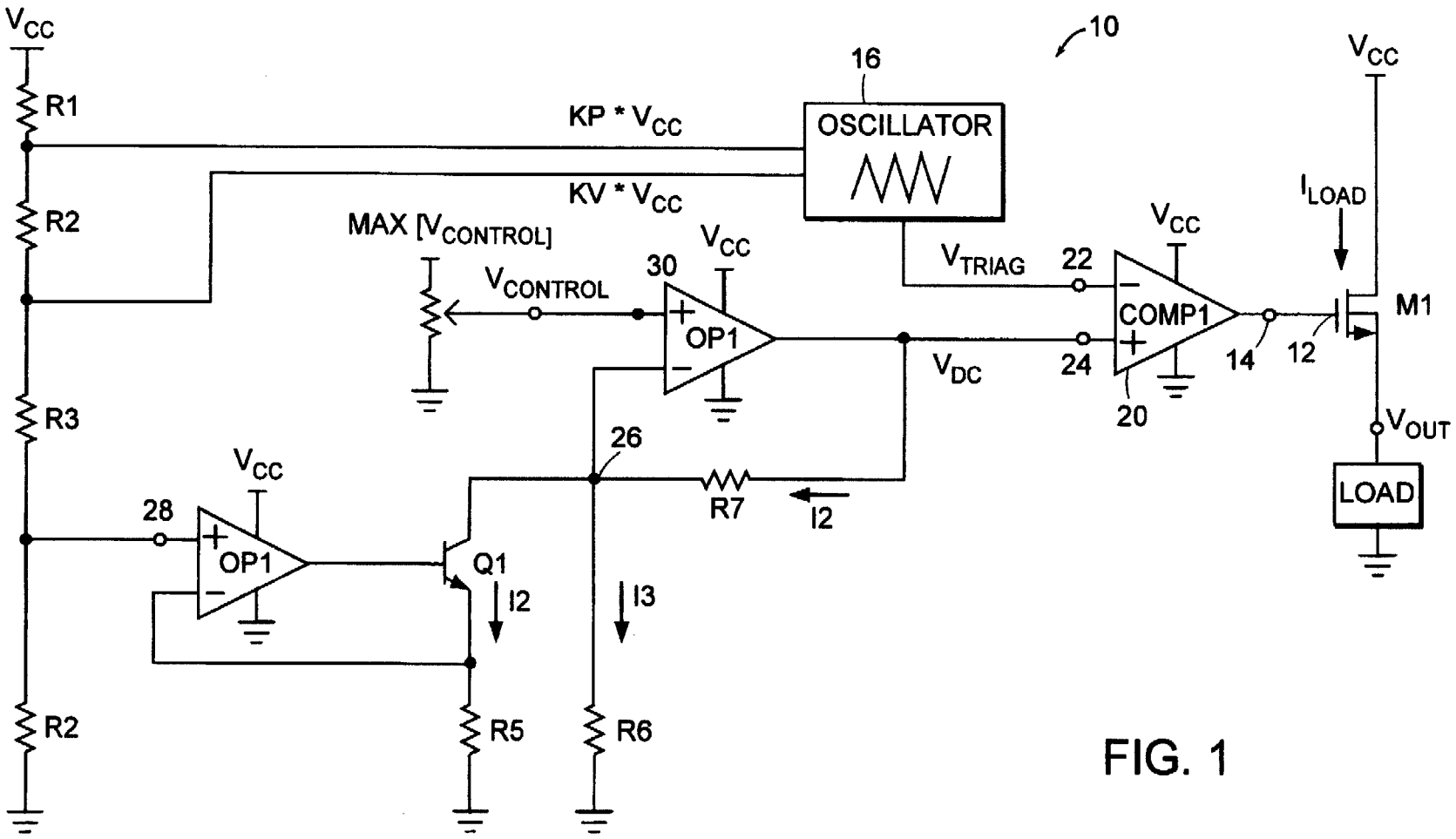
FIG. 1 is a schematic diagram of a pulse width modulator constructed in accordance with the present invention.

Referring now to FIG. 1, the pulse width modulator (PWM) is indicated generally by reference character 10. In the preferred embodiment, pulse width modulator 10 is implemented as a portion or entirety of an integrated circuit (not shown). As generally practiced in the art, pulse-width modulator circuits supply a square wave to the gate or base 12, of a power device M1. The duty cycle of the square wave is dependent upon a control voltage $V_{control}$, supplied by the application. Like conventional pulse width modulators, PWM 10 consists, fundamentally, of an oscillator 16 and a comparator 20. Oscillator 16 provides an oscillating voltage output to a first input port 22 of comparator 20. The temporal shape of the oscillating voltage output of oscillator 16 is that of a periodic sawtooth or triangle wave. A second input port 24 of comparator 20 is maintained at a compensated reference voltage $V_{dc}$ such that output 14 of comparator 20 is driven high during part of the period of oscillator 16, and during the remainder of the period of oscillator 16, output 14 of comparator 20 is driven low. Thus, output 14 of comparator 20 consists of pulses whose width, or duty cycle, is governed by adjustment of compensated reference voltage $V_{dc}$.

While operation of the invention requires that the waveform of oscillator 16 consist of linear ramps, either a triangle (symmetric) or sawtooth (asymmetric) waveform may be employed. Power device M1 may be a MOSFET, as shown by way of example, or any other power device known in the art. The drain or collector of power device M1 is connected to voltage supply $V_{cc}$, if the application requires a high-side driver, or the source or emitter of power device M1 is connected to ground, if the application requires a low-side driver. While the invention is described in terms of a high-side driver embodiment, as depicted in FIG. 1, it is to be understood that the low-side driver embodiment is also within the scope of the invention.

In high-side applications, when power device M1 is in the conducting ("on") state, power device M1 sources current $I_{LOAD}$, and pulls output voltage $V_{OUT}$ up to positive supply voltage $V_{cc}$. When power device M1 is off, no current flows and output $V_{OUT}$ floats to ground. The duty cycle of PWM 10 is the fraction of time output 14 of PWM 10 is high and drives power device M1 to conduct. During the balance of the time, output 14 of PWM 10 is at ground and power device M1 is off. Therefore, the average of output voltage $V_{OUT}$ changes with the duty cycle of PWM 10. In particular, the average of output voltage $V_{OUT}$ can be expressed as:

$$Vout_{avg}=\text{Duty Cycle} * \text{Supply Voltage}. \quad (1)$$

The invention is directed toward systems where control voltage $V_{control}$ is supplied in order to control average output voltage $Vout_{avg}$ according to:

$$Vout_{avg}=x * V_{control} \quad (2)$$

where x is a gain that expresses the constant of proportionality between output voltage $V_{out}$ and control voltage $V_{control}$ and is set by the application's needs. In particular, the peak values of control voltage $V_{control}$ and output voltage $V_{out}$ are related as:

$$x=\text{Nominal Supply Voltage}/\text{Max}[V_{control}]. \quad (3)$$

since output voltage $V_{out}$ can be as large as the nominal value of supply voltage $V_{cc}$. For example, if the nominal supply voltage is 14 V and the Maximum of $V_{control}$ is 5 V then x=2.8.

The requisite duty cycle for providing the desired average output voltage is derived by combining (1) and (2), yielding:

$$\text{Duty Cycle}=x * (V_{control}/V_{cc}). \quad (4)$$

It is evident from Equation (4) that, in order to provide an output voltage $V_{out}$ independent of supply voltage $V_{cc}$, it is necessary that the duty cycle be varied in inverse relation to the variations in supply voltage $V_{cc}$.

The invention is specifically intended for applications which employ an oscillator 16 whose peak and valley voltages are both fixed fractions of supply voltage $V_{cc}$. The transfer function described in equation (2) is easily implemented if the oscillator valley goes all the way to the ground supply rail, or, similarly, if the oscillator peak goes all the way to supply voltage $V_{cc}$. For example, if the oscillator ramped from ground to the supply voltage, and the comparator output were high when $V_{dc}$ is higher than the oscillator ramp voltage, then the duty cycle would simply be the fraction of $V_{cc}$ constituted by $V_{dc}$, and $$\text{Duty Cycle}=V_{dc}/V_{cc}=x\ V_{control}/V_{cc} \quad (5)$$

would obtain, as required, for an appropriately chosen gain factor x. Therefore the system compensates itself.

It is not practical, however, to design an oscillator in which at least one peak is a supply rail. That is because integrated oscillators charge and discharge a capacitor with current sources and allow comparators to determine the maximum and minimum voltages. Operating a trip point too close to a rail makes the triangle wave non-linear and therefore a poor oscillator for PWM applications. In order to avoid this, it is common practice to make the trip points for the oscillator be a percentage of the supply voltage. That gives the current sources enough head room to operate accurately. This will add an offset error term dependent upon Vcc to the $Vout_{avg}$ equation defined in equation (2). The invention cancels out this error term, in a manner now described.

Figure 2:
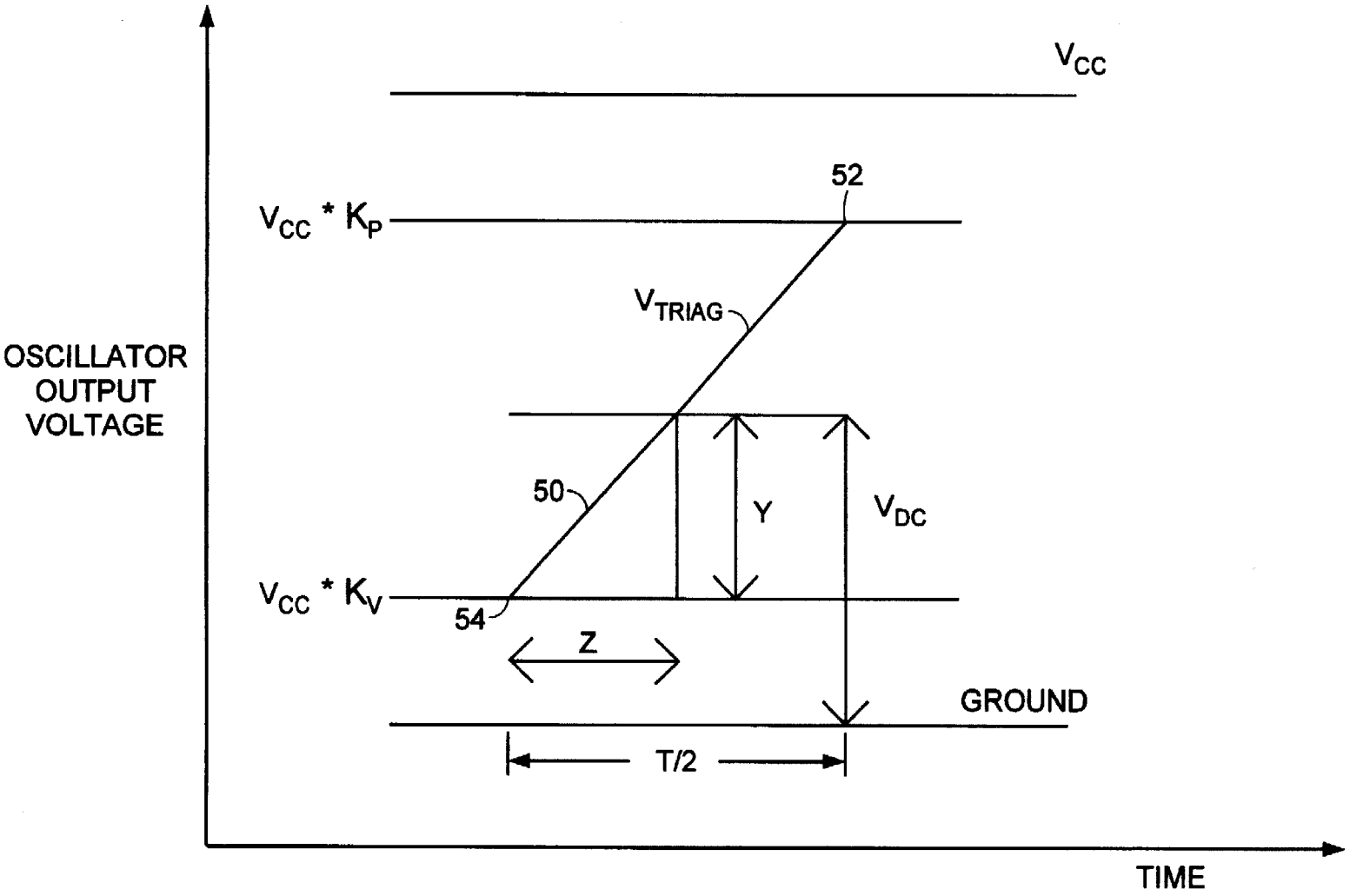
FIG. 2 is an illustration of the voltage level at the output of an oscillator as a function of time showing the effect of compensated reference voltage $V_{dc}$ on duty cycle in the present invention.

Referring now to FIG. 2, the ramp voltage $V_{triag}$ during half of the triangle wave is depicted as being compared to the compensated reference voltage, $V_{dc}$ required to produce the proper duty cycle for supply voltage compensation, while the horizontal axis represents time. In particular, T/2 is the duration of the positive-going ramp 50, while z is the duration during which $V_{dc}$ exceeds $V_{triag}$. Thus, $$\text{Duty Cycle}=z/(T/2) \quad (7)$$

The variables $k_p$ and $k_v$ are percentages of $V_{cc}$ that represent the peak 52 and valley 54 of oscillator ramp voltage $V_{triag}$ respectively. While the following analysis assumes that the output is high when $V_{dc}$ is larger than $V_{triag}$, it is to be understood that implementation with respect to the opposite polarity is also within the scope of the invention. The variable y represents the oscillator ramp voltage $V_{triag}$, with respect to valley 54 of oscillator ramp voltage $V_{triag}$, at which output 14 switches between high and low, i.e., $$y=V_{dc}-(k_v*V_{cc}). \quad (8)$$

Using similar right triangles, the duty cycle is derived as:

$$\text{Duty Cycle}=z/(T/2)=y/(V_{cc}*(k_p-k_v)), \quad (9)$$

and, by combining (8) with (9):

$$\text{Duty Cycle}=[V_{dc}/(V_{cc}*(k_p-k_v))]-(k_v/(k_p-k_v)). \quad (10)$$

Equating the expression (10) for the duty cycle with that of (4), and solving for Vdc yields the requisite transfer function:

$$v_{dc}=(x * V_{control}*(k_p-k_v))+(k_v*V_{cc}). \quad (11)$$

An implementation of this transfer function results in an average PWM voltage that is independent of supply voltage. Expressed in general terms, voltage $V_{dc}$ applied to second port 24 of comparator 20 is a linear combination of $V_{control}$ and $V_{cc}$.

A preferred embodiment of the invention for achieving the linear combination described by equation (11) is described with further reference to FIG. 1. Compensated voltage $V_{dc}$ is compared by comparator 20 to the triangle wave output of oscillator 16 to produce a PWM signal at output port 14 to drive the external power device M1. The peak 52 and valley 54 voltages (shown in FIG. 2) are set up by the resistor divider R1–R4, such that $$k_p=(R2+R3+R4)/(R1+R2+R3+R4), \quad (12)$$

and $$k_v=(R3+R4)/(R1+R2+R3+R4). \quad (13)$$

In this preferred embodiment, a first operational amplifier OP1, in conjunction with a transistor Q1 converts a voltage at input port 28 proportional to Vcc into a current I1 that is applied to a summing node 26 of a second operational amplifier OP2. Control voltage $V_{control}$ is applied to noninverting input port 30 of OP2 such that compensated reference voltage $V_{dc}$ appearing at second input 24 of comparator 20 equals:

$$Vdc=V_{control}\ (1+(R7/R6))+V_{cc}(R7/R5)(R4/(R1+R2+R3+R4)). \quad (14)$$

Since operational amplifier OP2 functions to maintain noninverting input port 30 and summing node 26 at an equal potential, a current 12 flows through resistor R7 which is the sum of current I1, proportional to $V_{cc}$ and sourced by transistor Q1, and current I3 through resistor R6 which is proportional to voltage $V_{control}$ at input port 30 and, thus, equivalently, at summing node 26. Consequently, compensated reference voltage $V_{dc}$ is the linear combination of $V_{control}$ and Vcc as given by Equation 14.

By equating (14) with (11), resistors R1 through R7 can be chosen to accommodate the parameters of a given application. This means of deriving Vdc provides isolation of Vcc from second operational amplifier OP2 to prevent undesirable interaction of circuit elements. Equation (14) shows that the accuracy of the system is only dependent on the accuracy of the resistor matching (R7 to R6 and R5, and R1 through R4 to each other) and the input offset voltages of operational amplifiers OP1 and OP2 and of comparator 20.

While FIG. 1 shows the preferred means for implementing the transfer equation described by (11), Some variations include:

(1) Providing a voltage proportional to $V_{cc}$ at non-inverting input port 28 of first operational amplifier OP1 by connecting non-inverting input port 28 of first operational amplifier OP1 to a resistor string between Vcc and ground which is separate from resistor string R1–R4;

(2) Using a current source referenced through a resistor to Vcc to develop current $I_1$;

(3) Having summing node 26 of the inverting terminal of OP2 connect through a resistor to a voltage divider off of supply voltage Vcc.

Variations (2) and (3) have less accuracy than the preferred embodiment shown in FIG. 1, but they are simpler implementations.

The described embodiments of the inventions are intended to be merely exemplary and numerous variations and modifications will be apparent to those skilled in the art. All such variations and modifications are intended to be within the scope of the present invention as defined in the appended claims.

I claim:

1. A pulse width modulator comprising:

a supply means for receiving a power supply voltage;

a comparator having a first input and a second input for providing a square wave output;

an oscillator, coupled to the first input of the comparator, for supplying a periodic ramp voltage having a peak proportional to the power supply voltage;

an operational amplifier coupled to the supply means and having a feedback loop;

a transistor included in the feedback loop so that the operational amplifier and the transistor provide a signal proportional to the power supply voltage; and a summing means, connected to receive the signal proportional to the power supply voltage and a control signal, for supplying a linear combination of the control signal and the power supply voltage to the second input of the comparator.

2. The pulse width modulator as set forth in claim 1 wherein the oscillator is a sawtooth generator.

3. The pulse width modulator as set forth in claim 1 wherein the oscillator is a triangle wave generator.

4. The pulse width modulator as set forth in claim 1 wherein the summing means is an operational amplifier having a noninverting input for receiving the control signal, an inverting input, and an output connected to the second input of the comparator.

5. The pulse width modulator as set forth in claim 4 wherein the inverting input of the operational amplifier is coupled to the circuit means for providing a signal proportional to the power supply voltage.

6. The pulse width modulator as set forth in claim 5 further including:

a shunt resistor connected between the inverting input of the operational amplifier and ground; and a feedback resistor connected between the inverting input of the operational amplifier and the output of the operational amplifier.

7. The pulse width modulator as set forth in claim 1 wherein the signal proportional to the power supply voltage is a current.

8. A pulse width modulator comprising:

a supply means for receiving a power supply voltage;

a comparator having a first input and a second input for providing a square wave output;

an oscillator, coupled to the first input of the comparator, for supplying a periodic ramp voltage having a peak proportional to the power supply voltage; and an op amp circuit having a first input connected to receive a control signal, a second input connected to receive a signal proportional to the power supply voltage and an output for supplying a linear combination of the control signal and the power supply voltage to the second input of the comparator.

9. The pulse width modulator as set forth in claim 8 wherein the oscillator is a sawtooth generator.

10. The pulse width modulator as set forth in claim 8 wherein the oscillator is a triangle wave generator.

11. The pulse width modulator as set forth in claim 8 further including:

a shunt resistor connected between the second input of the op amp circuit and ground; and a feedback resistor connected between the second input of the op amp circuit and the output of the op amp circuit.

12. The pulse width modulator as set forth in claim 8 further comprising a current source coupled to the power supply voltage for providing the signal proportional to the power supply voltage to the second input of said op amp circuit and wherein the signal proportional to the power supply voltage is a current.

13. The pulse width modulator as set forth in claim 12 wherein the current source comprises an operational amplifier and a transistor.

14. The pulse width modulator as set forth in claim 8 further comprising a plurality of series connected resistors connected to the supply means and wherein the signal proportional to the power supply voltage is derived from a voltage on one of the resistors in said plurality of series connected resistors.

15. The pulse width modulator as set forth in claim 14 wherein said oscillator is connected to said plurality of series connected resistors so as to supply a periodic ramp voltage that has a peak proportional to the power supply voltage.

16. The pulse width modulator as set forth in claim 15 further comprising a current source connected to receive the voltage on the one of the resistors in said plurality of series connected resistors for producing the signal proportional to the power supply voltage.

17. A method for regulating the fraction of time a power supply voltage is connected to a load, comprising the steps of:

(a) providing a cyclical ramp voltage having an oscillation period and a peak proportional to the power supply voltage;

(b) creating a linear combination of a control signal and the power supply voltage; and (c) switching a power device on to connect the load to the power supply voltage during a fraction of the oscillation period dependent upon a comparison between the cyclical ramp voltage and the linear combination of the control signal and the power supply voltage.

18. A pulse width modulated power circuit comprising:

a supply means for receiving a power supply voltage;

a power device coupled to said supply means for selectively sourcing output current from the power supply voltage;

a comparator having a first input and a second input for providing a square wave to control said power device;

an oscillator, coupled to the first input of the comparator, for supplying a periodic ramp voltage having a peak proportional to the power supply voltage;

a circuit means for providing a signal proportional to the power supply voltage; and a summing means, connected to receive the signal proportional to the power supply voltage and a control signal, for supplying a linear combination of the control signal and power supply voltage to the second input of the comparator.

19. The pulse width modulated power circuit as set forth in claim 18 further comprising a load connected to receive the output current sourced by the power device and wherein the pulse width modulated power circuit maintains an average voltage across the load that is substantially independent of the power supply voltage.

20. The pulse width modulated power circuit as set forth in claim 18 wherein the summing means is an operational amplifier having a noninverting input for receiving the control signal, an inverting input and an output connected to the second input of the comparator.

21. The pulse width modulated power circuit as set forth in claim 20 wherein the inverting input of the operational amplifier is coupled to the circuit means for providing a signal proportional to the power supply voltage.

22. The pulse width modulated power circuit as set forth in claim 21 further including:

a shunt resistor connected between the inverting input of the operational amplifier and ground; and a feedback resistor connected between the inverting input of the operational amplifier and the output of the operational amplifier.

23. The pulse width modulated power circuit as set forth in claim 18 wherein the circuit means for providing a signal proportional to the power supply voltage includes an operational amplifier and a transistor.

24. The pulse width modulated power circuit as set forth in claim 23 wherein the signal proportional to the power supply voltage is a current.

25. The pulse width modulated power circuit as set forth in claim 18 wherein the circuit means for providing a signal proportional to the power supply voltage includes a voltage divider connected to the supply means.

26. The pulse width modulated power circuit as set forth in claim 18 wherein the circuit means for providing a signal proportional to the power supply voltage comprises a current source connected to the supply means.

27. A pulse width modulator comprising:

a supply means for receiving a power supply voltage;

a comparator having a first input and a second input for providing a square wave output;

an oscillator, coupled to the first input of the comparator, for supplying a periodic ramp voltage having a peak proportional to the power supply voltage;

a voltage divider connected to the supply means so as to provide a signal proportional to the power supply voltage; and a summing means, connected to receive the signal proportional to the power supply voltage and a control signal, for supplying a linear combination of the control signal and the power supply voltage to the second input of the comparator.

28. The pulse width modulator as set forth in claim 27 wherein the summing means is an operational amplifier having a noninverting input for receiving the control signal, an inverting input, and an output connected to the second input of the comparator.

29. The pulse width modulator as set forth in claim 28 wherein the inverting input of the operational amplifier is coupled to the voltage divider.

30. The pulse width modulator as set forth in claim 29 further including:

a shunt resistor connected between the inverting input of the operational amplifier and ground; and a feedback resistor connected between the inverting input of the operational amplifier and the output of the operational amplifier.

31. A pulse width modulator comprising:

a supply means for receiving a power supply voltage;

a comparator having a first input and a second input for providing a square wave output;

an oscillator, coupled to the first input of the comparator, for supplying a periodic ramp voltage having a peak proportional to the power supply voltage;

a current source connected to the supply means to provide a signal proportional to the power supply voltage; and a summing means, connected to receive the signal proportional to the power supply voltage and a control signal, for supplying a linear combination of the control signal and the power supply voltage to the second input of the comparator.

32. The pulse width modulator as set forth in claim 31 wherein the summing means is an operational amplifier having a noninverting input for receiving the control signal, an inverting input, and an output connected to the second input of the comparator.

33. The pulse width modulator as set forth in claim 32 wherein the inverting input of the operational amplifier is coupled to the current source.

34. The pulse width modulator as set forth in claim 33 further including:

a shunt resistor connected between the inverting input of the operational amplifier and ground; and a feedback resistor connected between the inverting input of the operational amplifier and the output of the operational amplifier.

35. The pulse width modulator of claim 8 further comprising a power device having a control input connected to receive the square wave output from said comparator and being coupled to said supply means so as to selectively conduct an output current from the power supply voltage in response to the square wave output.

* * * * *